US005677592A

United States Patent [19]

Choi et al.

[11] Patent Number: 5,677,592

[45] Date of Patent: Oct. 14, 1997

[54] CATHODE RAY TUBE

[75] Inventors: Jong-seo Choi, Anyang; Kwi-seuk Choi; Kyu-nam Joo, both of Seoul, all of Rep. of Korea

[73] Assignee: Samsung Display Devices Co., Ltd., Kyungki-do, Rep. of Korea

[21] Appl. No.: 690,833

[22] Filed: Aug. 1, 1996

[30] Foreign Application Priority Data

Sep. 30, 1995 [KR] Rep. of Korea ..... 95-33983

[51] Int. Cl.[6] ..... H01J 29/07; H01J 29/92

[52] U.S. Cl. ..... 313/477 HC; 313/479; 313/408

[58] Field of Search ..... 313/477 HC, 479, 313/402, 404, 407, 408

[56] References Cited

U.S. PATENT DOCUMENTS 4,188,564 2/1980 Zegers et al. ..... 313/477 HC X
4,230,966 10/1980 Compen ..... 313/477 HC X
4,380,715 4/1983 Postma ..... 313/479 X
4,845,404 7/1989 Van Buren ..... 313/477 HC
5,196,764 3/1993 Kim et al. ..... 313/479 X
5,220,242 6/1993 Choi ..... 313/479

*Primary Examiner*—Ashok Patel
*Attorney, Agent, or Firm*—Leydig, Voit & Mayer

[57] ABSTRACT

A cathode ray tube is constructed such that a resistance of a first conductive element connected to a metal film on the inner side of the panel is lower than a resistance of a second conductive element connected to a shadow mask. Thus, the amount of electrons which are emitted from an electron gun to strike the metal film increases, to thereby enhance luminance, and the amount of electrons striking the shadow mask is decreased, to thereby reduce thermal deformation of the shadow mask.

3 Claims, 2 Drawing Sheets

CATHODE RAY TUBE

BACKGROUND OF THE INVENTION

The present invention relates, to a cathode ray tube, and more particularly, to a cathode ray tube in which luminance is enhanced and a doming phenomenon of the shadow mask is reduced.

A conventional cathode ray rube, includes a panel 10, a funnel 20 which is sealed to the panel and an electron gun 80 installed in the neck portion of the funnel 20, as shown in FIG. 1*a*. As shown in FIG. 1*b*, a phosphor layer 11 and a metal film 12, such as aluminum, are sequentially coated to the inner side of the panel 10. A stud pin 13 is connected to the inner sidewall of the panel 10 and electrically connected to the metal film 12 by a graphite layer 14 as shown in FIGS. 1*b* and 2. The inside of the funnel 20 is coated with a conductive layer 21 of graphite, which is electrically connected to an anode terminal 22 connected at one side of the funnel 20. A frame 40 is fixed to the panel 10 by coupling a leaf spring 41, which is fixed on the sidewalls of the frame 40, with the stud pin 13. A shadow mask 30 having beam passing holes 31 is fixed on the front panel side of the frame 40 and faces the metal film 12 at a predetermined distance. Rearward of the frame 40, an inner shield 50 is fixed and supported by a connection spring 70. Here, one end of a conductive spring 60 is tightly fixed between the frame 40 and inner shield 50, and the other end thereof is in contact with the conductive layer 21 of the funnel 20.

In the constructed conventional cathode ray tube 90, when a high voltage is supplied through the anode terminal 22 to the conductive layer 21 of the inside of the funnel 20, the voltage is supplied to the frame 40 and to the shadow mask 30 electrically connected to the frame through the conductive spring 60. The substantially same voltage as that supplied to the shadow mask 30 is supplied to the metal film 12 on the inside of the panel 10 through the leaf spring 41, stud pin 13 and graphite layer 14. Here, electrons emitted from the electron gun 80 travel toward the metal film 12 and are accelerated by the high voltage supplied to metal film 12. Part of the electrons pass through the beam passing holes 31 of the shadow mask 30, and the remainder thereof strike the shadow mask 30. The electrons having passed through the beam passing holes 31 then strike the phosphor of the phosphor layer 11 through the metal film 12, to thereby emit light from the phosphor. However, the electrons striking the shadow mask 30 cause a doming phenomenon, wherein the shadow mask 30 is heated and then thermally dilated to impart a smaller curvature radius.

Meanwhile, when the amount of electrons which have passed through the beam passing holes 31 to strike the metal film 12 is increased to increase the amount of current flowing in the metal film 12, the luminance is enhanced and the amount of electrons striking the shadow mask 30 is decreased to reduce the amount of the current flowing in the shadow mask 30 relatively. Accordingly, the amount of thermal deformation of the shadow mask is reduced so that an image of a high quality is formed.

Thus, various studies have been made to increase the amount of electrons passing through beam passing holes 31 of the shadow mask 30 and then colliding against metal film 12. However, 70% or more of the electrons emitted from the electron gun 80 collide against the shadow mask 30 without passing through beam passing hole 31, so that enhancement of the luminance and suppression of the doming phenomenon cannot be effectively realized.

SUMMARY OF THE INVENTION

Accordingly, it is an object of the present invention to provide a cathode ray tube in which the amount of electrons which are emitted from an electron gun and then pass through beam passing holes are increased, so that the luminance is enhanced and the amount of thermal deformation of the shadow mask is effectively reduced.

To accomplish the above object of the present invention, there is provided a cathode ray tube comprising: a panel having an inside surface where a phosphor layer and a metal film are sequentially coated; a funnel sealed to the panel; an electron gun installed in the neck portion of the funnel; and a shadow mask having a multiplicity of beam passing holes through which electron beams emitted from the electron gun toward the metal film of the panel pass and fixed with respect to the panel, wherein electric potential applied to the metal film is higher than that applied to the shadow mask.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1A:
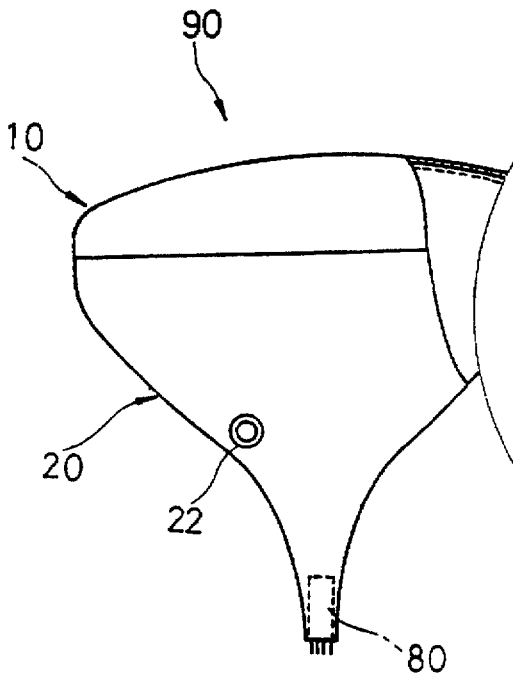
FIG. 1a (PRIOR ART)
FIGS. 1*a* and 1*b* are, respectively, a schematic sectional view and an enlarged partial sectional view of a conventional cathode ray tube.
Figure 1B:
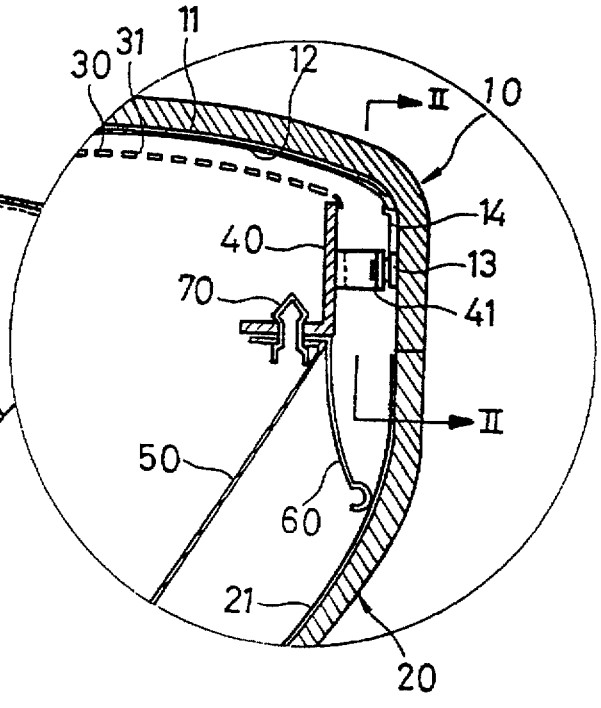
FIG. 1b (PRIOR ART)
Figure 2:
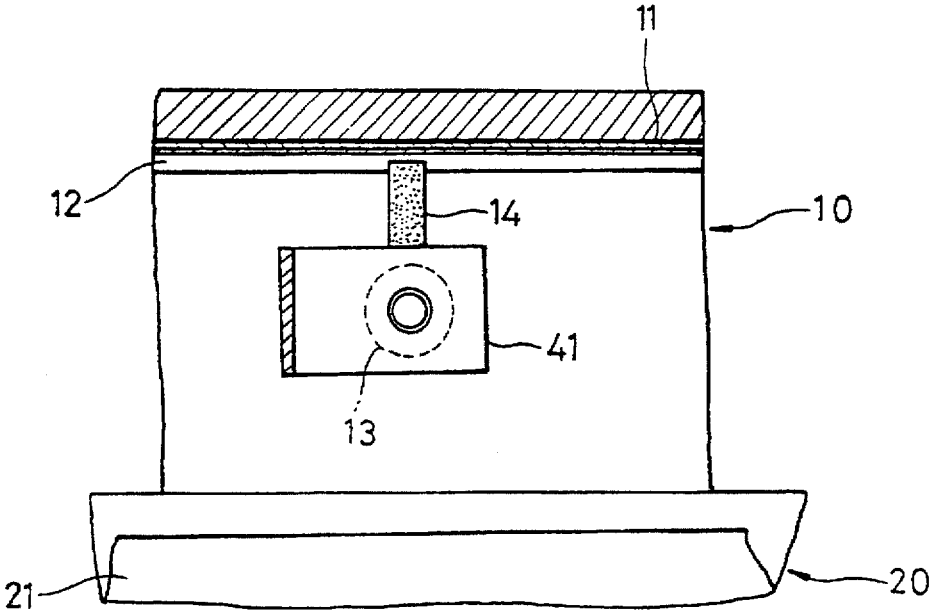
FIG.2(PRIOR ART)
FIG. 2 is a sectional view along line II—II of FIG. 1.
Figure 3A:
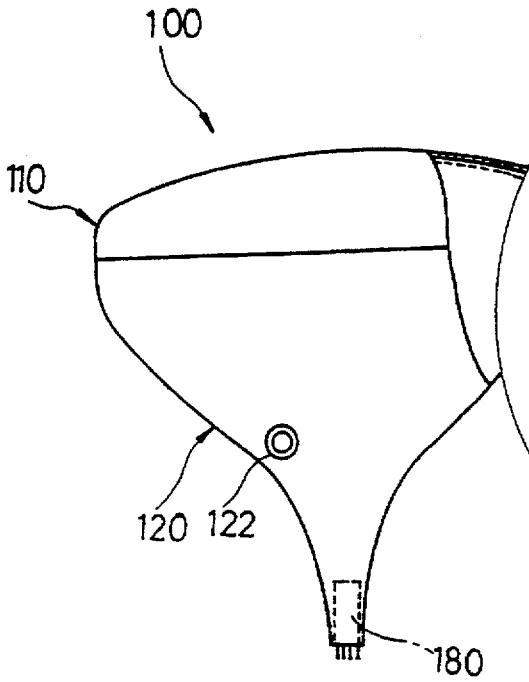
FIG. 3*a* and 3*b* are, respectively, a schematic sectional view and an enlarged partial sectional view of a cathode ray tube according to the present invention.
Figure 3B:
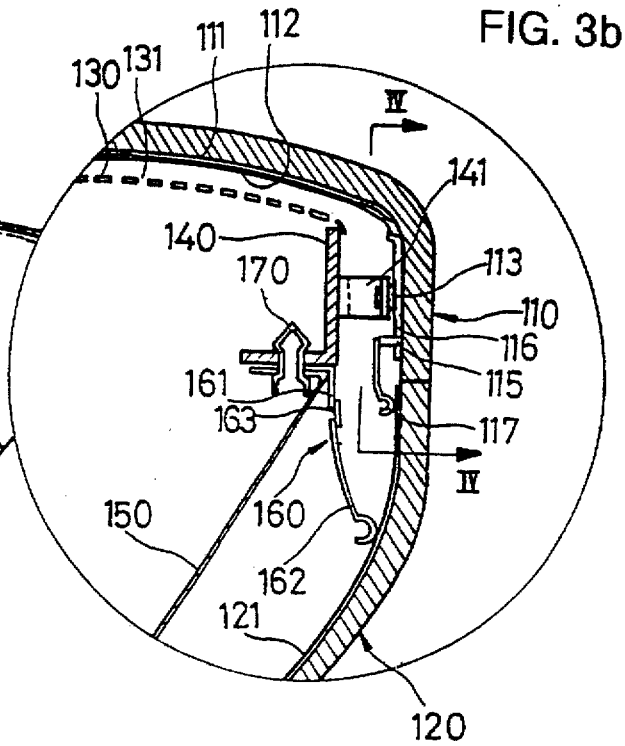
Figure 4:
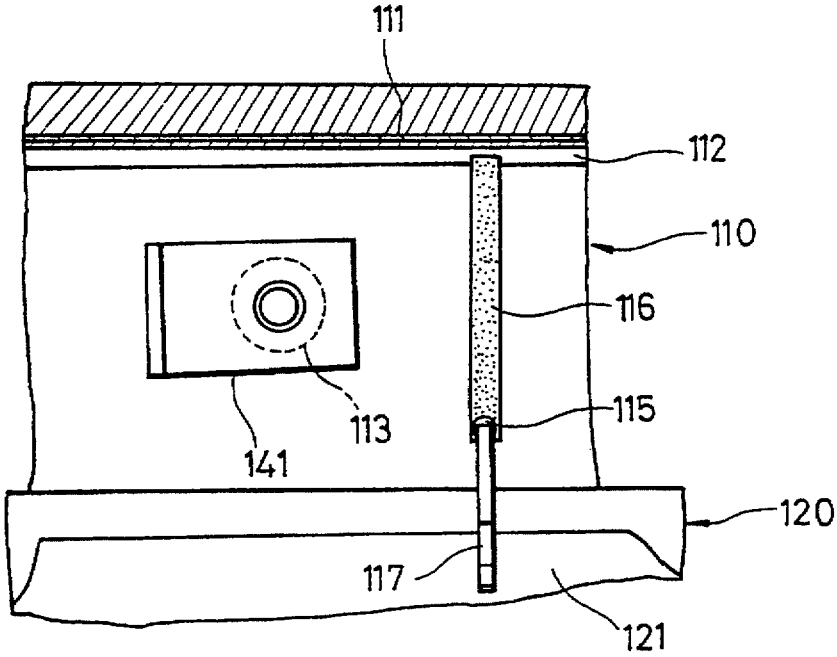
FIG. 4 is a sectional view along line IV—IV of FIG. 3.

Referring to FIGS. 3*a*, 3*b* and 4, a cathode ray tube 100 according to the present invention includes a panel 110 and a funnel 120 which is sealed to the panel 110 and an electron gun 180 installed in the neck portion of the funnel 120. On the inner side of the panel 110, a phosphor layer 111 coated with red, green and blue phosphors and a metal film 112 such as aluminum are sequentially accumulated. The inside of the funnel 120 is coated with graphite to form a conductive layer 121. The conductive layer 121 is connected electrically to an anode terminal 122 connected to the funnel 120 for connection to an external electrical terminal (not shown).

A frame 140 is fixed to the panel 110 by coupling a leaf spring 141 fixed on the sidewall of the frame 140 to a stud pin 113 connected to the inner sidewall of the panel 110. A shadow mask 130 having beam passing holes 131 is fixed on the front side of the frame 140. Here, the shadow mask 130 faces the metal film 112 at a predetermined distance. On the back side of the frame 140, an inner shield 150 is fixed and supported by a connection spring 170.

While the metal film 12 of the inside of the panel 10 and the stud pin 13 are electrically connected to each other by the graphite layer 14 in the conventional cathode ray tube 90, the graphite layer is not coated between the metal film 112 and stud pin 113 in the cathode ray tube 100 of the present embodiment as shown in FIG. 4. Accordingly, an insulation state can be maintained between the metal film 112 and stud pin 113, and thus between the shadow mask 130 and metal film 112.

The metal film 112 and shadow mask 130, which are insulated from each other, are electrically connected to the conductive layer 121 of the inside of the funnel 120 by first and second conductive means, where the electrical resistance value of the second conductive means is greater than that of the first conductive means.

According to the present embodiment, the first conductive means for electrically the connecting the metal film 112 of the inside of the panel 110 to the conductive layer 121 of the inside of the funnel 120 is comprised of a conductive pin 115 connected to the inner wall of the panel 110, a graphite layer 116 for electrically connecting the metal film 112 to the conductive pin 115, a first conductor 117 having one end welded to the conductive pin 115 and the other end contacting with the conductive layer 121 of the inside of the funnel 120.

The second conductive means for electrically connecting the shadow mask 130 to the conductive layer 121 of the inside of the funnel 120 includes a second conductor 160. Here, the second conductor 160 has a first conductive member 161 electrically connected to the frame 140 where the shadow mask 130 is fixed, a second member 162 electrically connected to the conductive layer 121 of the inside of the funnel 120, and a third member 163 having a predetermined electrical resistance value and for electrically connecting the first member 161 to the second member 162.

Accordingly, the electrical resistance value of the first conductive means, i.e., the sum of resistances of the elements constituting the first conductive means is negligible, while the electrical resistance value of the second conductive means, i.e., the sum of resistances of the elements constituting the second conductive means is considerably high due to the third member 163 of the second conductor 160.

In the cathode ray tube 100 constructed as described above, when a high voltage is supplied to the conductive layer 121 of the inside of the funnel 120 through connection of the anode terminal 122 to the external electrical terminal, predetermined electrical potentials are applied to the metal film 112 through the first conductive means, and to the shadow mask 130 through the second conductive means, respectively. Here, since the second conductor 160 constituting the second conductive means has the third member 163 of a predetermined resistance value, voltage drop across the third member 163 imparts the shadow mask 130 with an electrical potential lower than that of the metal film 112.

When electrons are emitted from the electron gun 180, the emitted electrons are accelerated toward the metal film 112. Here, part of the electrons pass through the beam passing holes 131 of the shadow mask 130 to strike the metal film 112, with the remainder thereof striking the shadow mask 130. As described above, since the electrical potential applied to the metal film 112 is higher than that applied to the shadow mask 130, the amount of electrons striking the metal film 112 is increased to increase the amount of the current flowing in the metal film 112 and the amount of electrons colliding against shadow mask 130 is decreased to reduce the amount of the current flowing in the shadow mask 130, as compared with the conventional cathode ray tube 90 where the same electrical potentials are applied to the shadow mask 130 and the metal film 112. Accordingly, the luminance is enhanced and the amount of thermal deformation of the shadow mask 130 is reduced. According to the present inventor's experiment, compared with the conventional cathode ray tube, the cathode ray tube as described above has shown a 30–100% enhancement in luminance and a 10–50% reduction in the thermal deformation of the shadow mask 130, according to change of the resistance value of the third member 163.

According to the present invention, the resistance value of the second conductive means for electrically connecting the conductive layer 121 of the inside of the funnel 120 to the shadow mask 130 can be obtained by employing the second conductor 160 including the first member 161 connected to the shadow mask 130, the second member 162 connected to the conductive layer 121 and the third member 163 for connecting the first member to the second member and having the predetermined resistance value. The third member 163, however, can be electrically connected directly to the shadow mask 130 or to the conductive layer 121 without one of the first member 161 and second member 162. Alternatively, the second conductor 160 can be formed of only the third member 163, and one end of the second conductor 160 can be fixed to the shadow mask 130 with the other end thereof being in direct contact with the conductive layer 121.

It is also possible to manufacture the first conductor 117 of the first conductive means and the conductive pin 115 thereof integrally, which are independently produced and then welded to each other in the above description.

Meanwhile, in order to apply the electrical potential higher than that applied to the shadow mask 130 to the metal film 112, there may be various methods other than the above-described construction of the first and second conductive means. For example, an additional terminal similar to the anode terminal 122 formed on the funnel 120 may be connected to the panel 110 or to the funnel 120. Then, a first voltage is supplied to the shadow mask 130 through the anode terminal 122 and a second voltage, which is higher than the first voltage, is supplied to the metal film 112 through the additional terminal, so that the electrical potential applied to the metal film 112 is higher than that applied to the shadow mask 130.

The cathode ray tube according to the present invention, as described above, is constructed such that the electrical potential applied to the metal film on the inner side of the panel is higher than that applied to the shadow mask. Thus, the amount of electrons which are emitted from the electron gun and strike the metal film is increased, to thereby enhance the luminance, and the amount of electrons which strike the shadow mask is decreased, to thereby reduce the amount of thermal deformation of shadow mask.

What is claimed is:

1. A cathode ray tube comprising:

a panel having an inside surface where a phosphor layer and a metal film are sequentially coated;

a funnel having an inside surface where a conductive layer is formed and having a neck portion, said funnel being sealed to said panel;

an electron gun disposed in the neck portion of said funnel, said electron gun emitting electron beams;

a shadow mask having a plurality of beam passing holes through which the electron beams pass, said shadow mask being fixed with respect to said panel, wherein the metal film and said shadow mask are insulated from each other;

first conductive means for electrically connecting the metal film to the conductive layer of said funnel; and second conductive means for electrically connecting said shadow mask to the conductive layer of said funnel, said second conductive means having a resistance value higher than a resistance value of said first conductive means.

2. A cathode ray tube according to claim 1, wherein said first conductive means comprises:

a conductive pin connected to the inner surface of said panel;

a graphite layer electrically connecting the metal film to said conductive pin; and a first conductor having one end welded to said conductive pin and the other end contacting the conductive layer of said funnel.

3. A cathode ray tube according to claim 1, wherein said second conductive means comprises:

a first conductive member electrically connected to said frame;

a second member electrically connected to the conductive layer of said funnel; and a third member electrically connecting said first member to said second member, said third member having a predetermined resistance value.

* * * * *